US005333402A

United States Patent [19]

Weir

[11] Patent Number: 5,333,402

[45] Date of Patent: Aug. 2, 1994

[54] SHEET CORNER TRANSFER SYSTEM

[75] Inventor: Henry J. Weir, Chepstow, England

[73] Assignee: Wecotec, Ltd., Chepstow, England

[21] Appl. No.: 905,935

[22] Filed: Jun. 29, 1992

[30] Foreign Application Priority Data

Jun. 28, 1991 [GB] United Kingdom ..... 9114002
Dec. 20, 1991 [GB] United Kingdom ..... 9127314
Jun. 10, 1992 [GB] United Kingdom ..... 9212275

[51] Int. Cl.[5] ..... B65H 7/02; D06F 67/04

[52] U.S. Cl. ..... 38/143; 271/268; 271/85

[58] Field of Search ..... 271/1, 85, 268, 306; 38/102.91, 143, 7; 26/52, 53; 28/203.1

[56] References Cited

U.S. PATENT DOCUMENTS 3,376,036 4/1968 Weir ..... 271/54
3,604,132 9/1971 Thompson et al. ..... 38/143
3,664,046 5/1972 Thompson ..... 38/143
4,371,159 2/1983 Doyen et al. ..... 271/1 X
4,967,495 11/1990 Weir ..... 38/143

FOREIGN PATENT DOCUMENTS 1105901 5/1966 United Kingdom ..... D06F 67/04
1169513 1/1967 United Kingdom ..... D06F 67/04
2219313 12/1989 United Kingdom ..... 38/143

*Primary Examiner*—D. Glenn Dayoan
*Assistant Examiner*—Boris Milef
*Attorney, Agent, or Firm*—Wallenstein, Wagner & Hattis, Ltd.

[57] ABSTRACT

The disclosure relates to a sheet spreader for a sheet feeder apparatus comprising at least one pair of sheet clamps, a guideway extending along an entry to a sheet feeder, clamps mounted on the guideway for movement along the entry to the sheet feeder and a plurality of sheet loading stations located at fixed positions opposite the guideway. Each loading station has a sheet clipping system to receive and support a pair of corners of a sheet and for effecting transfer of the sheet corners from the clipping system to the pair of sheet clamps on the guideway when the clamps are located in a transfer position adjacent the loading station. The sheet clamps of each pair move independently of one other, first together in a transfer position at a respective loading station and then apart to spread the sheet received at a loading station for entry to the sheet feeder.

26 Claims, 17 Drawing Sheets

SHEET CORNER TRANSFER SYSTEM

DESCRIPTION

1. Technical Field of the Invention

The invention relates to spreader feeding machines for laundry and textile sheet fabric materials. Such machines are well known in the industry and over a number of years many various designs and types have been available to the markets.

BACKGROUND OF THE INVENTION

The machines which concern the invention are those where one or more operators manually load the corners of an article such as a sheet or table cloth onto sheet corner-receiving clipping or clamping means. Such machines are described in the following patent specifications: U.K. Nos. 1105901, 1168513 and U.S. Pat. No. 3,664,046.

Production speeds of modern laundry processing equipment (such as ironing and folding machines) have risen significantly. A single or a number of operators cannot safely load the sheet corners to match desired production requirements with the sheet clipping or clamping means heretofore developed.

According to the known state of the art described in the above mentioned patents, the loading and transfer of the sheet corners present undesirable limitations. Clamping and spreading means are arranged to move inward and outward from a fixed central feed line position. A critical mechanical movement is necessary for the clamping means to receive the top edge corners of the sheet. The loading positions where multi-operator usage can be effectively employed is limited to the practical mechanics of the positioning movements of clipping or clamping means to a central transfer position.

A further limitation is the portion of the corner which is actually gripped by the clamp. This is a relatively small area of the top edge of the sheet and consequently limits the amounts of desirable tensioning force which can be exerted to spread the leading edge of the sheet without causing damage and tearing of the fabric. Outward spreading speeds and forces must therefore be restricted to prevent such damage occurring.

An object of the present invention is to increase with safety to the operators the transfer speed of the corners of a sheet from a loading position to the clamping means.

It is of paramount importance that the operators not be exposed to accidental contact with the sheet spreader clamps when they are in motion, since they travel at a dangerously high rate of speed. It is this high rate of speed which can be achieved with such spreader clamps that necessitates multiple loading stations to provide the most rapid utilization of machine feed rate.

More specifically, the purpose of the invention is to provide improved means for initially clip loading the corners of a sheet, coupled with a fast transfer of the loaded corners from clipping means to the clamping means which effect a high speed spreading and tensioning of the leading edge portion of the sheet in preparation for an onward feeding process of the sheet.

SUMMARY OF THE INVENTION

This invention provides a sheet spreader for a sheet feed apparatus comprising at least one pair of sheet clamps uniquely designed to receive lengths of the side edges of the opposite top corners of a sheet to be spread.

Means are provided to move the pair of clamps between adjacent positions to spaced apart positions to spread the sheet therebetween, prior to being discharged from the clamps at the inlet to a sheet feeding apparatus. Each clamp has separable jaws to receive at a transfer station the two corners of the sheet from a unique pair of clipping means. The pair of clamps are brought together for this transfer operation. The clipping means receive the two upper corners of a sheet fed by an operator at a loading station, where the pair of clipping means suspend the sheet corners, in a manner which locates the adjacent side edges of the sheet for reliable transfer to the separated jaws of the respective clamps. Means are provided to effect the transfer of these side edges of the sheet to the separated clamp jaws, while adjacent portions of the sheet are still held by a gripping section of each clipping means. These sections of the clipping means are released from the sheet after the side edges of the sheet corners are transferred to the separated jaws of the clamps and the clamp jaws are closed. The closed pair of clamps can then be separated so the sheet is tensioned by the clamps for entry to the sheet feeding apparatus.

Each sheet clipping means most advantageously has two sheet-gripping sections, one which grips the side edge portion of the sheet and the other which grips an adjacent portion of the sheet spaced therefrom. During sheet transfer, the former section is initially released from the sheet so that the adjacent side edge of the sheet can be transferred to the separated jaws of one of the clamps by a blast of air or other means, whereupon the other section is also released when the side edge is gripped by the clamp jaws. In one particular arrangement according to the invention, each clipping means at each loading station may include a vertically extending sheet support member, with adjacent or opposite vertical sides against which the pair of clip sections referred to respectively press the side edge and spaced adjacent portions of a sheet corner, until released sequentially in the manner described.

In accordance with another aspect of the invention, the sheet clamps receive and hold a significant length of the side edge corner portions of the sheet (e.g. 120 to 200 mm), so that the sheet is not unduly stressed by the spreading and tensioning forces of the sheet clamps. It will be understood that the length of side edge of the sheet gripped by each clamp controls the amount of tension which can be applied without damaging the fabric.

Another feature of the invention relates to the paths of movement of the clamps and clipping means to effect the transfer of the sheet corners from the clipping means to the clamps. The invention is useful with one or more pairs of clamps. Each pair of clamps is mounted for independent movement along a guideway to extend along an entry to the sheet feeding apparatus. For maximum sheet feeding efficiency, a number of transfer stations are provided along the guideway spaced opposite various loading stations where one or a pair of said clipping means may be located for manual insertion of the upper corners of a sheet by an operator. Each pair of clipping means at each loading station is preferably supported for bodily movement from an initial loading position at a convenient height for access to an operator to a transfer position at the adjacent transfer station which preferably, but not necessarily, is at a much higher elevation. Each pair of clamps are mounted for movement preferably to a computer selected transfer station where the associated clipping means is ready to transfer the corners of a sheet thereto. When a pair of clamps so moved receives the corners of a sheet at a selected transfer station, they are preferably moved together to a central portion of the guideway, which is opposite the center of a portion of the sheet feeding apparatus, where the pair of clamps are moved apart to spread the sheet.

Air jet means on the members directed towards the clamps in the transfer position thereof displace the side edge portions of the sheet laid on the members into the clamps when one of the clips is released as previously described, the clipping means are moved to said transfer position.

More specifically, the sheet support members may be of hollow box form having an elongate slit extending down the sides of the members facing the clamps in the transfer position and means being provided for supplying air under pressure to the hollow members to issue as an elongate jet from the slit to blow the sheet side edge portions laid against the members into the clamps.

According to a further feature, of the invention the means for retaining the side edge portions of the sheet laid against the elongate members of the clipping means may comprise presser elements biased against the remote sides of the support members to hold the side edge portions of the sheet against the members with a relatively light pressure and means are provided to relieve the presser members to allow release of the side edge portions of the sheet for transfer into the clamps.

In a further arrangement according to the invention, the clipping means may include a pair of elongate vertically extending flexible tongues which the sheet edge portions may be wrapped around, the tongues being moved into the sheet clamps by said movement of the clipping means which act to grip and remove the sheet edge portions from the tongues when the latter retract with the clipping means leaving the sheet edge portions retained by the clamps.

It will be appreciated that the invention is applicable to a number of different forms of sheet feeders and sheet clamping arrangements. The arrangements described in the following patent specifications are particularly suitable:

Feeders:

European No. 0153069 dated Aug. 28, 1991

U.S. Pat. No. 4,729,181 dated Mar. 8, 1988

U.S. Pat. No. 4,967,495 dated Nov. 6, 1990

European Appln. No. 0345087 dated Jun. 2, 1989

Clamping:

U.S. Pat. No. 499,326 dated Feb. 12, 1991

European Appln. No. 0341084 dated May 5, 1989

It will, of course, be understood that the invention can be also used in conjunction with other feeding machines and clamping arrangements.

DETAILED DESCRIPTION OF THE INVENTION

Figure 1:
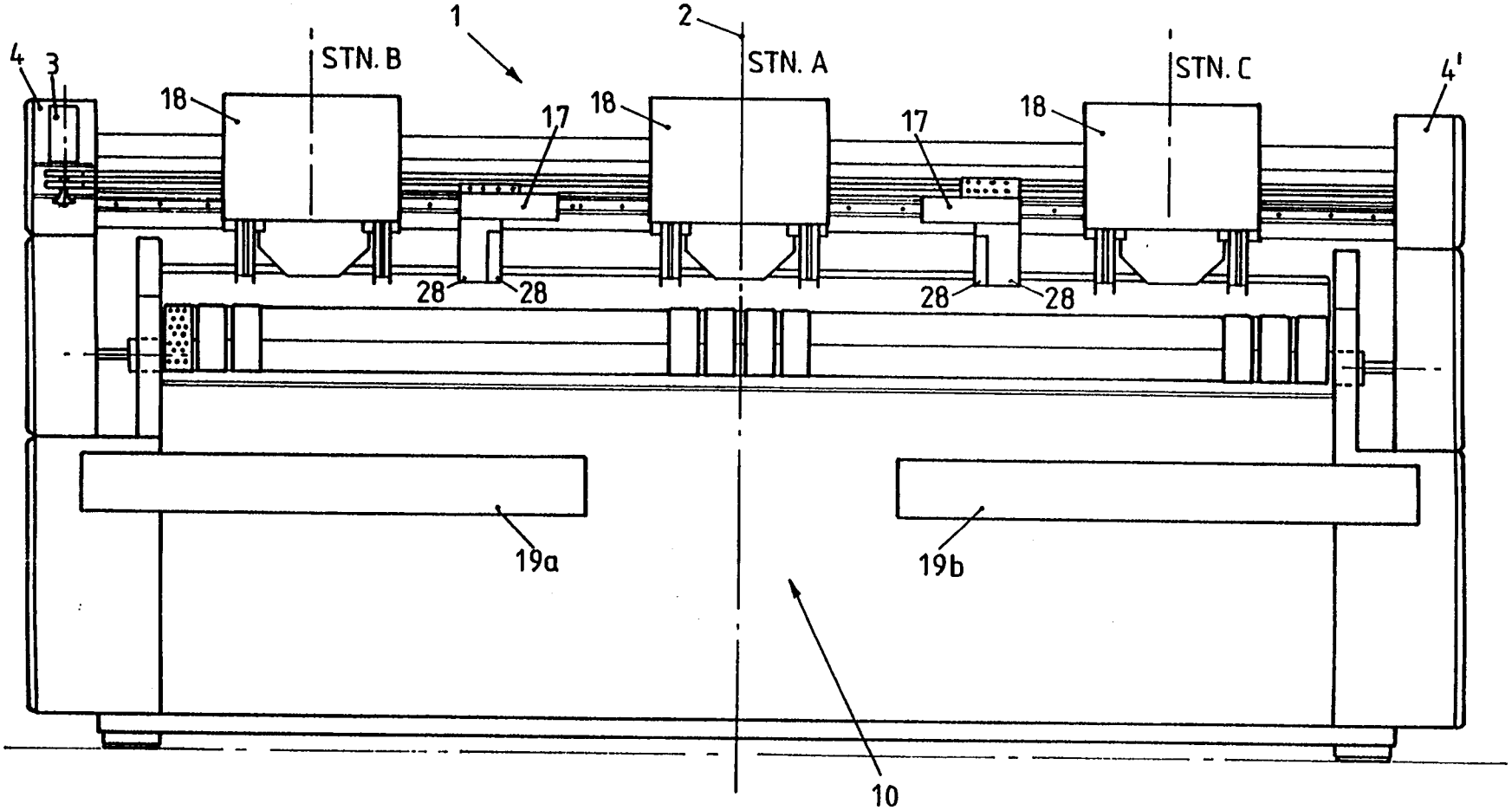
FIG. 1 is a front elevation of a sheet feeder embodying a sheet spreader in accordance with the invention.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to embodiment illustrated.

Figure 2:
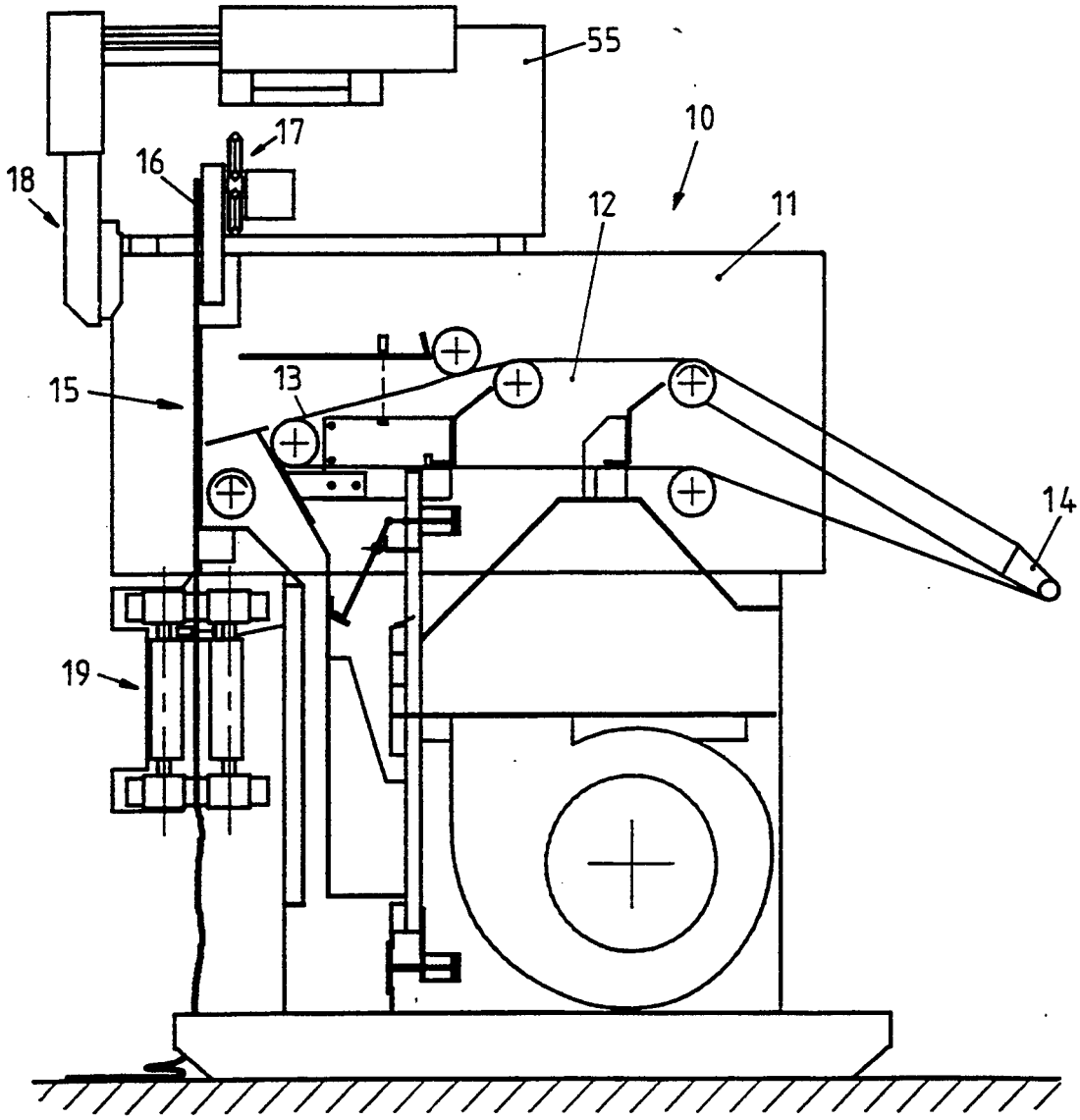
FIG. 2 is a sectional side elevation view of the sheet feeder/sheet spreader.
Figure 3:
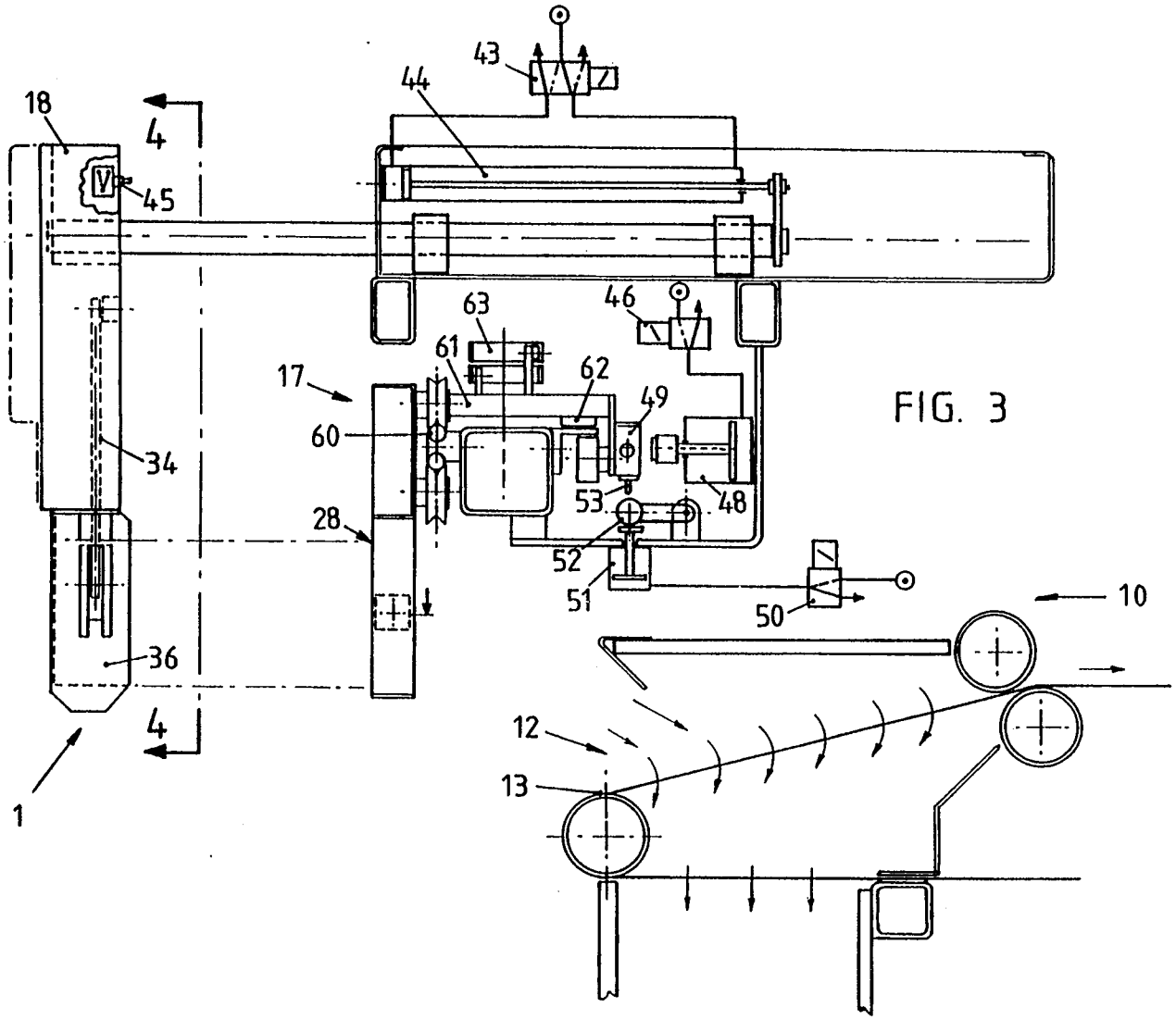
FIG. 3 is a sectional side view of the sheet spreader and part of the sheet feeder showing the arrangement in greater detail.

Referring firstly to FIGS. 1 and 2 of the drawings, a sheet spreader according to the invention is shown indicated generally at 1 installed on a sheet feeder indicated generally at 10 and constructed in accordance with the principles described and illustrated in European patent specification no. 0153069 and U.S. patent specification Ser. No. 4,729,181. The feeder includes a housing 11 through which the multiple belt form conveyor 12 extends having a receiving end indicated generally at 13 and a delivery end indicated at 14.

The housing 11 has an entry 15 extending along the width of the conveyor and through which spread sheets are drawn by vacuum drawn within the housing onto the feed end of the conveyor to be fed by the conveyor through the housing and to an ironer or other industry processing equipment.

The sheet spreader 1 supports a sheet 20 to be received by the feeder draped across the entry to the housing and suspended from clamps 17 mounted on a linear horizontally extending track mechanism extending along the housing above the entry. Sheets to be processed are temporarily supported on one of three loading stations 18, one positioned on the spreader center line 2 with the other loading stations disposed on either side of the center line. Each loading station 18 has a pair of clipping mechanisms for temporarily holding the corners of a sheet for transfer to the sheet clamps and then to be spread apart along the entry to the housing as described in detail below. After spreading, the leading edge of the sheet is drawn by vacuum created in the housing into the housing and onto the feed end of the conveyor which then draws the sheet through the housing and delivers it to the ironer as described in detail in the European and U.S. patent specifications referred to above.

Below the entry to the housing left and right hand pairs of spreader belts generally disposed at location 19*a* and 19*b* are provided spaced apart one either side of the spreader center line 2 to permit passage of a bunched sheet between the pairs of belts prior to spreading. The edges of the sheet are drawn between the belts by the separation of the clamps so that the body of the sheet is spread out by the spreader belts as the sheet is drawn through the belts to ensure that the sheet is laid on the conveyor in a flat condition without creases or wrinkles.

FIGS. 3 to 8 show details of a loading station 18 and its location in relation to the spreader clamps 17 and the feeding machine conveyor 12. The loading station has a spaced pair of downwardly extending clip bodies 36 and a pair of main clips 30 operated by air cylinders 31 in response to activation of switch sensors 32 acting on the inner sides of the clip bodies. When the top edge of a sheet corner is inserted into the open mouth of a clip 30, valve 33 supplies air pressure to the clip cylinder 31 which closes the clip to hold the top edge of the sheet as indicated at 21 on FIG. 8 adjacent the sheet corner against the clip body 36. A subsidiary pair of clips (corner clips) act on the outer sides of the clip bodies, each comprising a lightly spring loaded lever 34 with a smooth shoe 35 attached to the end provides the location hold of the side edge of the sheet corner, indicated at 22 on FIG. 8, against the clip body 36. It will be noted from FIG. 8 that the vertical length of the location hold 22 is much greater than the width thereof. Manual loading is executed by laying the corners of the sheet 20 around the lower portions of the clip bodies 36 and then sliding the corners up the bodies to engage said top edge portions 21 in the clips 30 and to locate the side edge portions 22 under the shoes 35.

Figure 8:
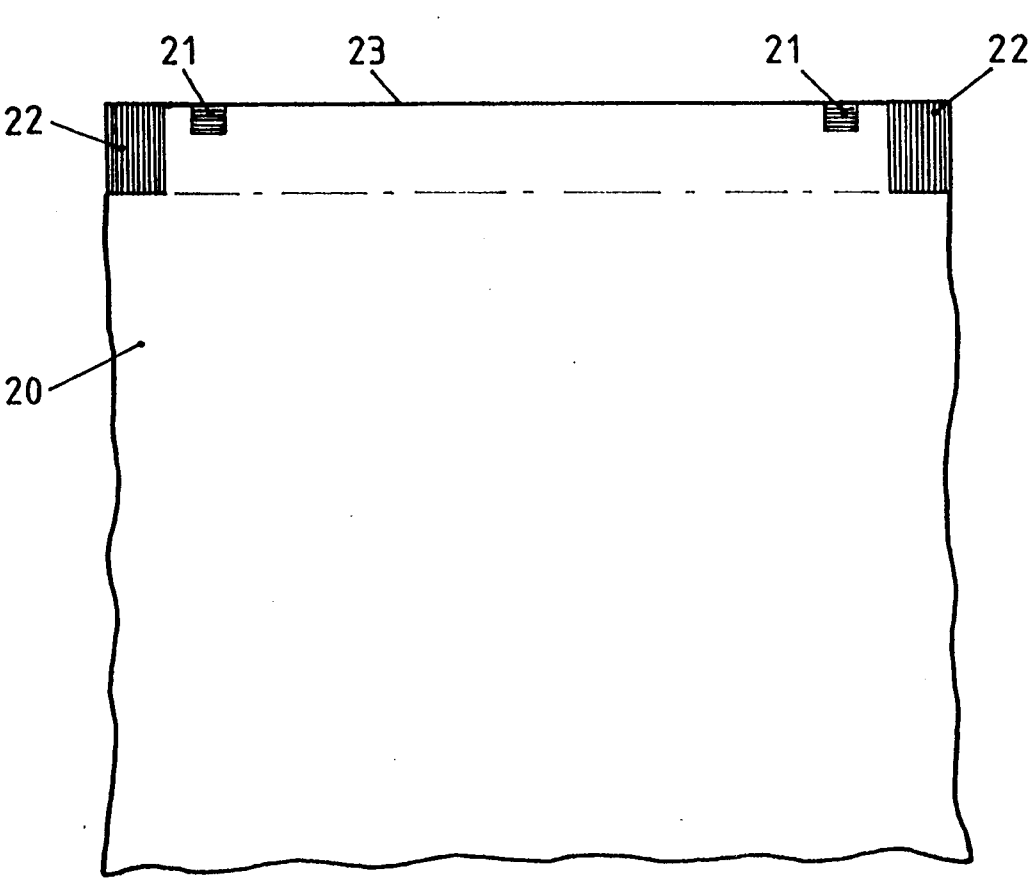
FIGS. 7 and 8 illustrate a sheet suspending from the sheet spreader in bunched and spread conditions with the areas on the sheet end engaged by the sheet clips indicated.
Figure 7:
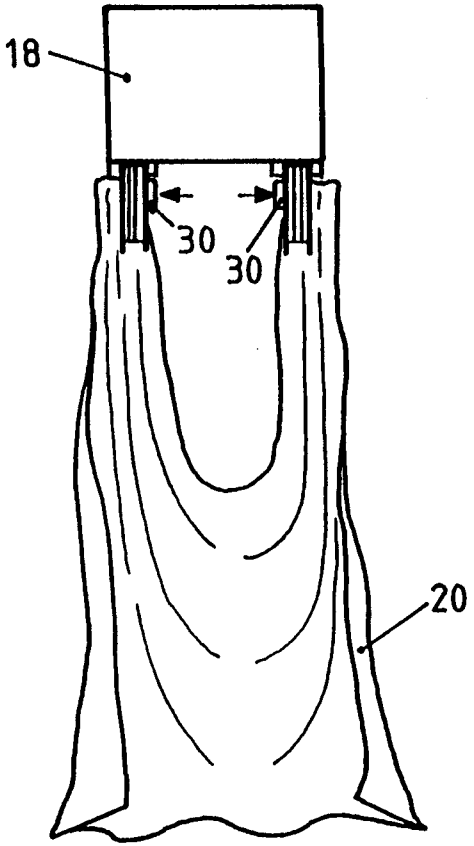

Reference is now made to FIGS. 7 and 8 of the drawings which show a sheet 20 in bunched and spread conditions. The shaded areas 21 indicate the top edge portions of the corner which are held by the main clips 30. The shaded portions 22 are the side edges which are temporarily held by the subsidiary clips 34, 35 before transfer to the spreader clamps 17. The leading edge 23 of the sheet 20 is spread and tensioned by the spreader clamps as described below.

Figure 4:
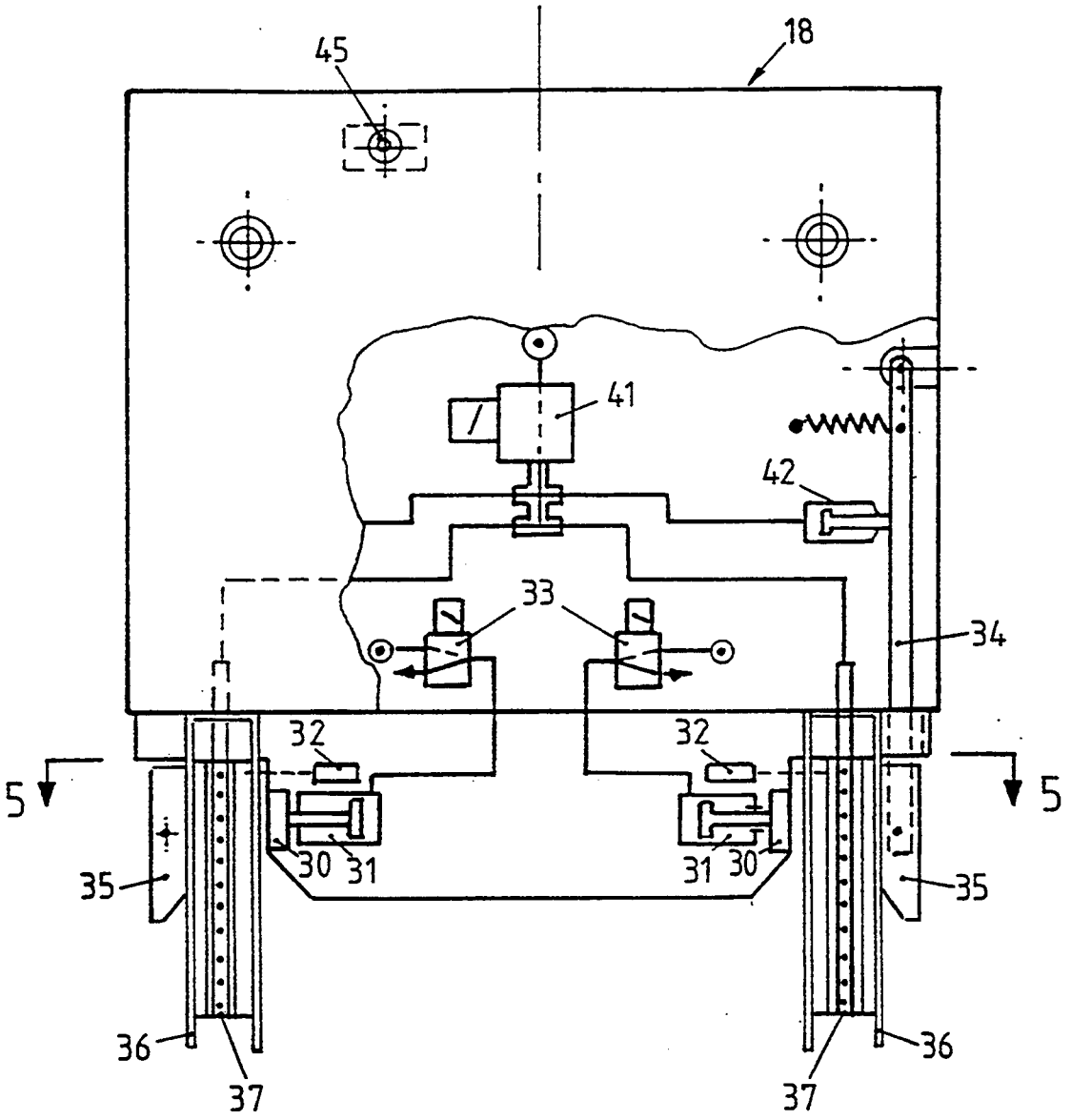
FIG. 4 is a sectional rear elevation on the line 4—4 on FIG. 3.
Figure 5:
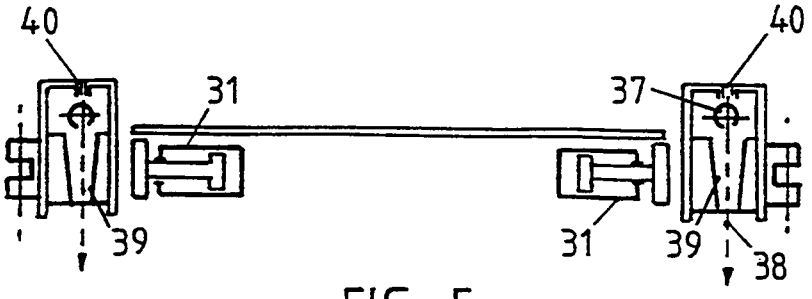
FIG. 5 is a sectional plan view on the line 5—5 on FIG. 4.

Each clip body 36 houses air jet tubes 37 which are arranged to blow through the aperture 38 (see FIG. 6) and transfer the sheet corner into the jaws of the clamps. A venturi shaped liner 39 and a slotted opening 40 in the front of the clip body causes atmospheric air to be drawn into the body when the air jets are triggered. This results in an increased volume and spread of the air blow and also reduces the directional intensity of the high pressure air jets. Compressed air is fed to both air jet tubes by the valve 41 (FIG. 4). This valve also feeds air to the air cylinders 42 which lift the location shoes 35 and release the side edge corners for transfer into the clamp jaws 28. These operations all occur simultaneously in approximately 80 milli-seconds which is the time it takes to execute the sheet corner transfer into the spreader clamps.

The load station sequences are initiated when both the switching sensors 32 are activated by the presence of the two sheet corners in the clips 30. These signals are stored in a micro-processor control system and dealt with in order of loading. Servo drives 3 (see FIG. 1) are independently directed to position the spreader clamps 17 adjacent to the load station position to be transferred. The processor outputs a signal to valve 43 which activates the air cylinder 44 which in turn positions the load station into the proximity of the spreader clamps 17. The initiation of switch 45 on the load station by its contact with the support frame for the load station signals to the processor that the station is in the transfer position. Valve 41 is then triggered together with valve 46. The air jets blow the corner of the sheet into the clamp jaws 28. The jaw closing cylinders 47 of the clamps 17 are activated by compressed air via the injector cylinder 48 and non-return valve 49. The sheet corners are thus transferred and held in the clamps. The processor then deactivates valves 33 and 46. The clips 30 release their hold on the corners which drop out. The injector cylinder 48 retracts from its contact with the non-return valve 49. Valve 43 is deactivated and the load station retracts to the loading position, as will be discussed in detail subsequently.

It will be noted with respect to FIG. 7 that corners of the sheet 20, when so suspended by the clips 30, 35 drape nearly vertically in the vicinity of the clips. Thus, since both clips are supported from the top, as long as they move adequately away from the clip bodies when releasing the sheet, it is clear that the sheet corners will be drawn off of the clip assemblies without fouling once the jaws have been engaged and the clips released.

The servo motors are then activated to move the spreader clamps to a central feed position and then spread and tension the leading edge of the sheet. When the preset spreading and tensioning torque value is sensed by the servo drive system, the processor initiates a small reversal movement of the motors partially to relax the tension in the leading edge of the sheet. The suction feed under the feeding machine conveyor 12 is activated simultaneously with a brief activation of valve 50 which initiates the clamp release air cylinder 51 which in turn moves the release bar 52 (see FIG. 12) to depress the actuator plungers 53 of the non-return valve 49 and exhaust the air from the clamp cylinder 47, thereby opening the clamp jaws to release the sheet to the feeding machine conveyor.

It will be appreciated that other forms of motor may be used instead of the servo motors referred to for the belt drives. For example, stepper motors or braked motors responsive to sensors placed along the guideway could be utilized.

The spreader just described is applicable to the feeding system disclosed in European Patent No. 0153069, or alternatively to the feeding system described in European Patent Publication No. 0345087.

The sheet spreading mechanisms are housed in a bridge structure 55 comprising three support beams terminating in two side frame boxes (not shown). This structure spans above and across the feeding machine conveyor 12.

The clamps 17 are attached to a pair of wheeled carriages 61 running on a track 60 and a second stabilizing track 62 and, as shown in FIG. 1, are driven by two servo motors 3, 3' located in the side frame boxes 4, 4'. Power is transmitted to each carriage by endless toothed belts 63. The 2 axis servo motor drives 3, 3' are micro processor controlled. The processor control can be programmed to locate or move the carriages to any required position along the track. Spreading torque values for tensioning the leading edge of the sheet can also be programmed by setting appropriate motor current supply. It is also possible to extend the length of the bridge and tracks to position two pairs of clamps and carriages incorporating a 4 axis servo drive system. This will permit the effective use of up to six loading stations to support very high production requirements.

Figure 6:
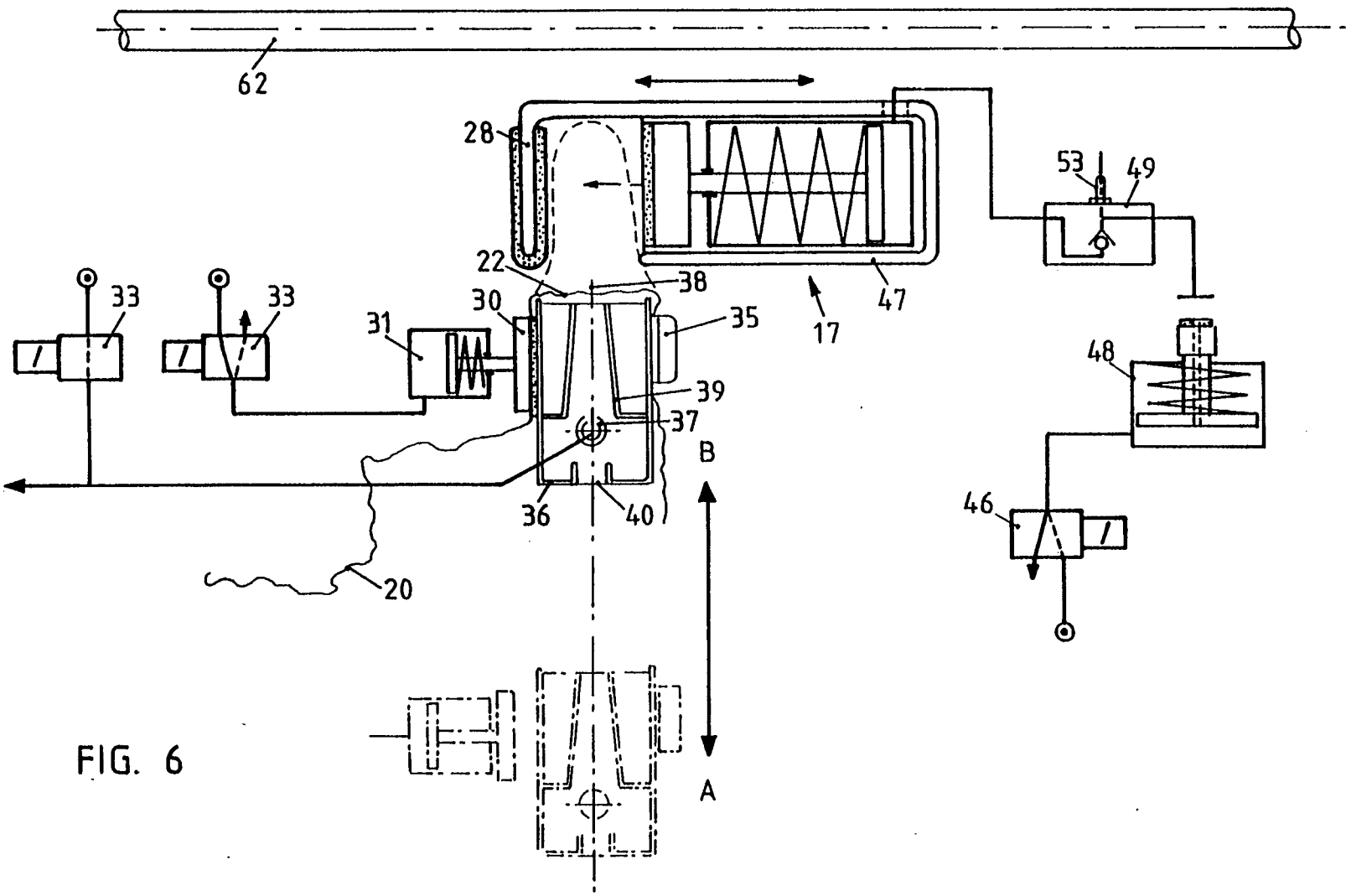
FIG. 6 is a sectional plan view of one sheet clamp and one sheet clip of the sheet spreader at the transfer station.

FIG. 6 is a diagrammatic plan view of the clipping mechanism and clamp mechanism with pneumatic control circuits. This diagram shows the sheet corner being blown into the clamp jaws 28. Clip position 'A" is the loading point. Position 'B" is the transfer point. The corner of the sheet is held in the clamp 28 with a doubled over edge. This edge is automatically drawn out by the suction effect of the feeding operation.

Figure 9:
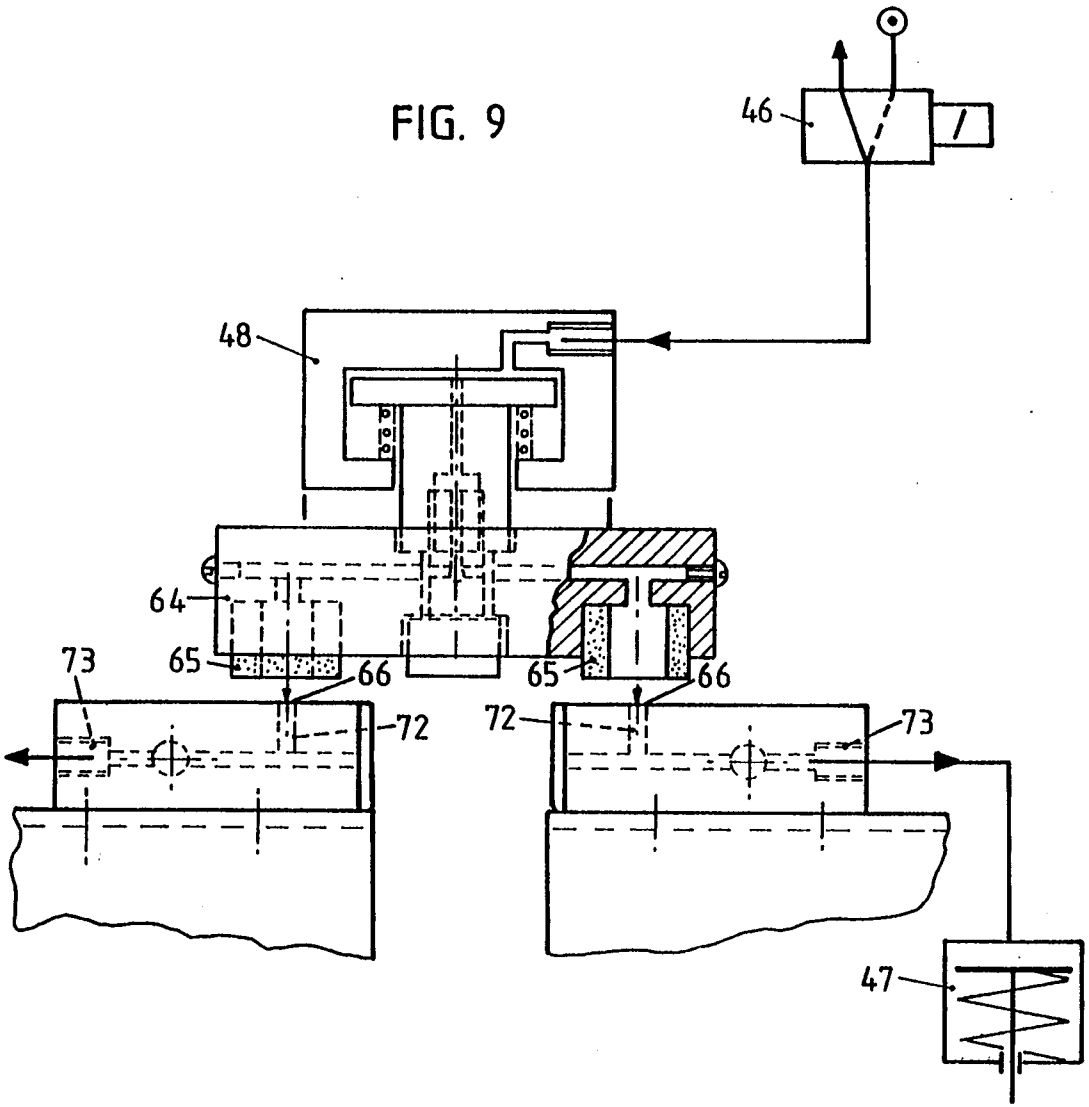
FIG. 9 shows the arrangement for supplying air pressure to the pneumatically operate sheet clamps of the spreader.

FIGS. 9 and 2 are detail views showing how air pressure is fed into the air cylinders 47 of the clamps 17 in the transfer position. When the spreader carriages 61 are moved to the transfer position, the non-return valves 49 are lined up with the air injection cylinder 48 and its double outlet nozzle 64. Actuation of valve 46 feed compressed air into the injector cylinder 48, which thrusts the nozzle seals 65 over the port holes 66 in the non-return valve bodies 49. The air then feeds through the non-return valve and activates the clamp cylinder 47, thereby closing the clamp jaws 28. The nozzle is retracted when valve 46 is deactivated and the air pressure is trapped in the clamp cylinder until the actuator plunger 53 of the non-return valve 49 is depressed by the release bar 52, when the trapped air is exhausted and the clamp jaws open.

Figure 11:
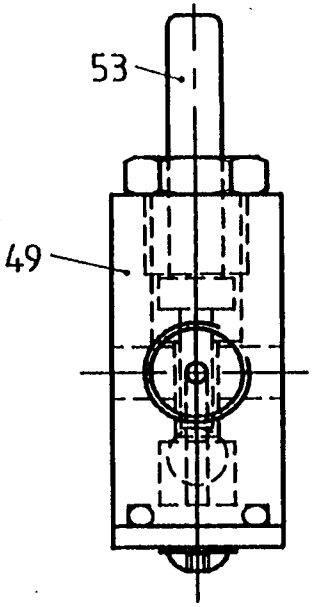
FIGS. 10 and 11 illustrate the valve arrangement for retaining air pressure in the sheet clamp.
Figure 10:
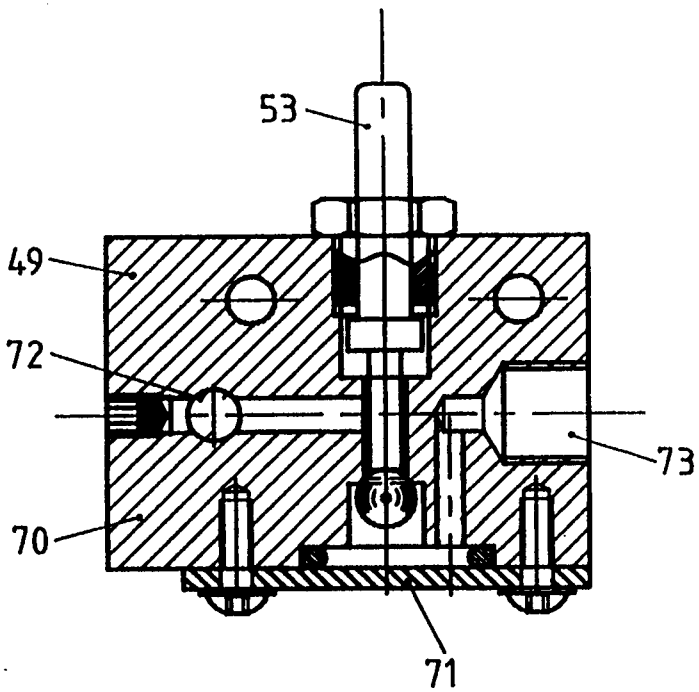

FIGS. 10 and 11 show the non-return valve 49 which comprises a block body 70, a neoprene ball 71, a release plunger 53, compressed air feed entry port 72 and an air outlet port 73 to clamp 30. The ball 71 only permits one way flow of the air until it is lifted off its seat by the plunger when air is exhausted back through port 72.

Figure 12:
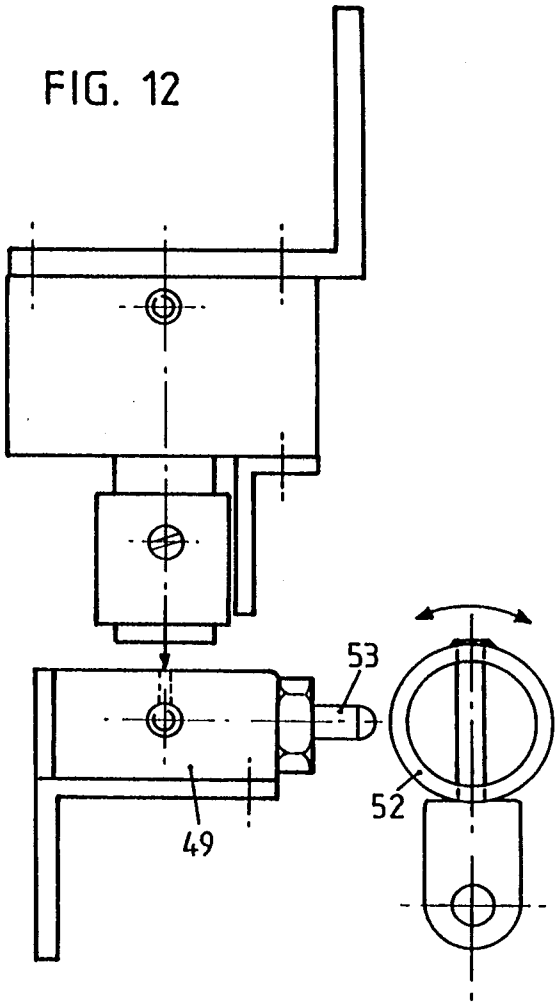
FIG. 12 illustrates the mechanism for releasing air pressure from the sheet clamps.
Figure 13:
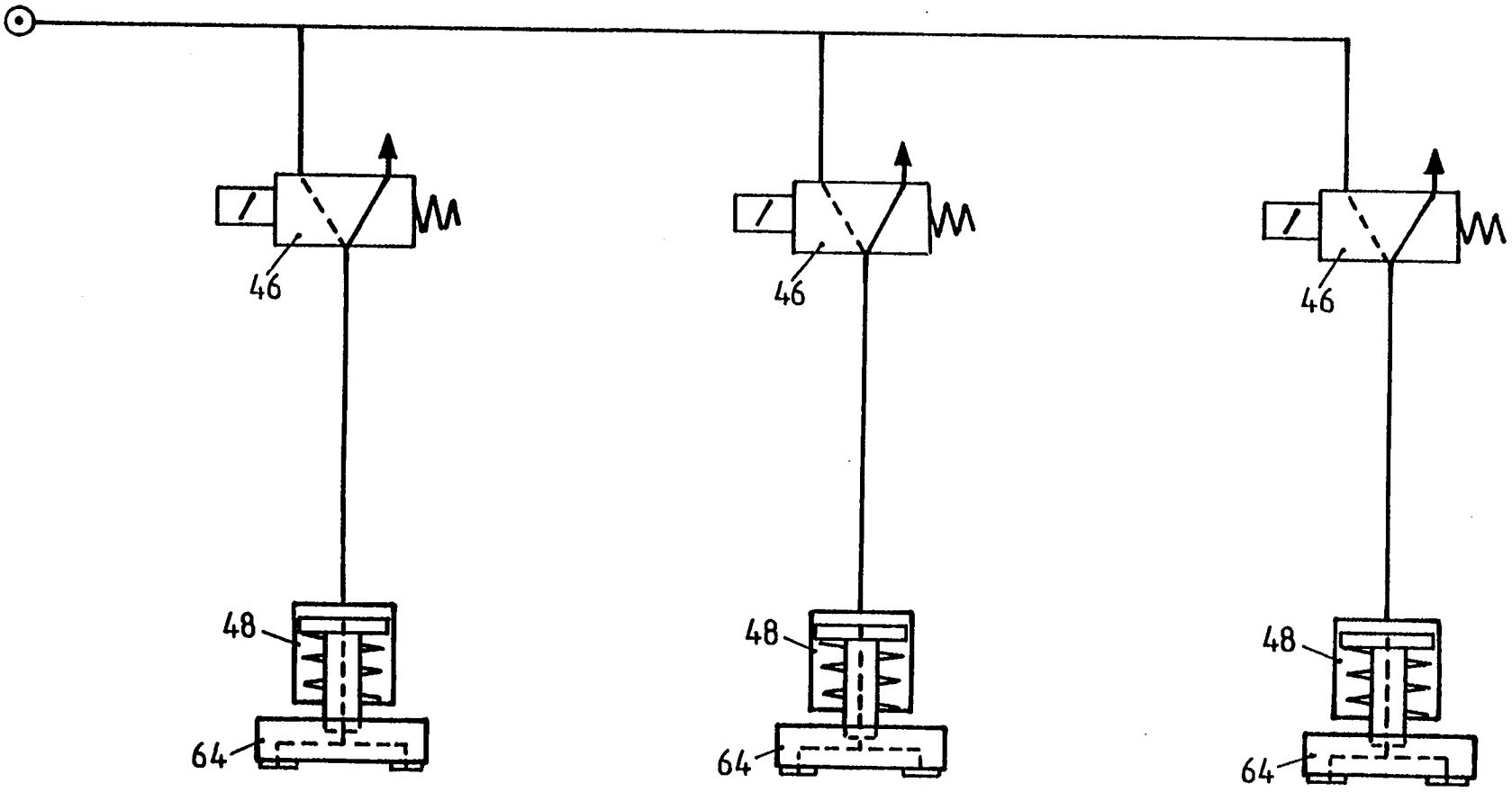
FIG. 13 is a similar view to FIG. 9 showing an arrangement for supplying air pressure to pairs of sheet clamps at three transfer stations at spaced locations along the entry to a sheet feeder.
Figure 14A:
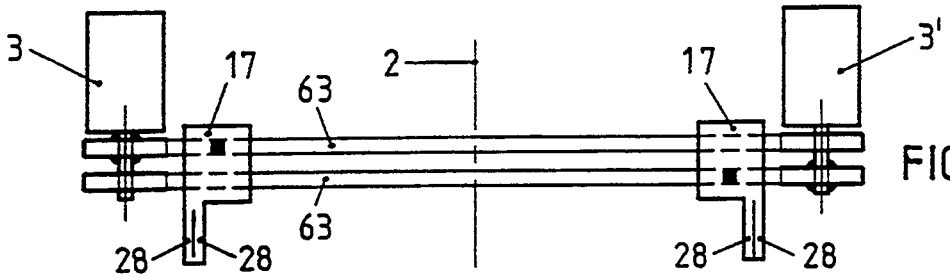
FIGS. 14A–14D, 15A–15E, and 16A–16E are diagrammatic illustrations showing sheet clipping and spreading at three different transfer locations spaced along the entry to the sheet feeder.
Figure 14B:
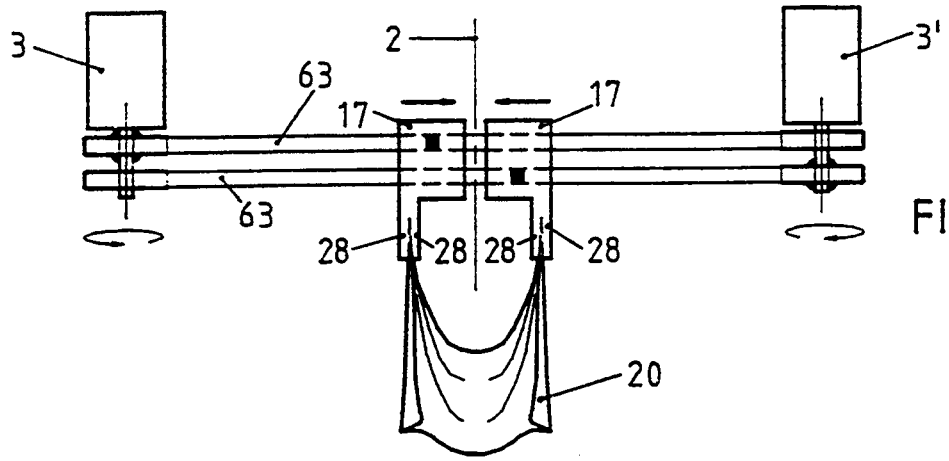
Figure 14C:
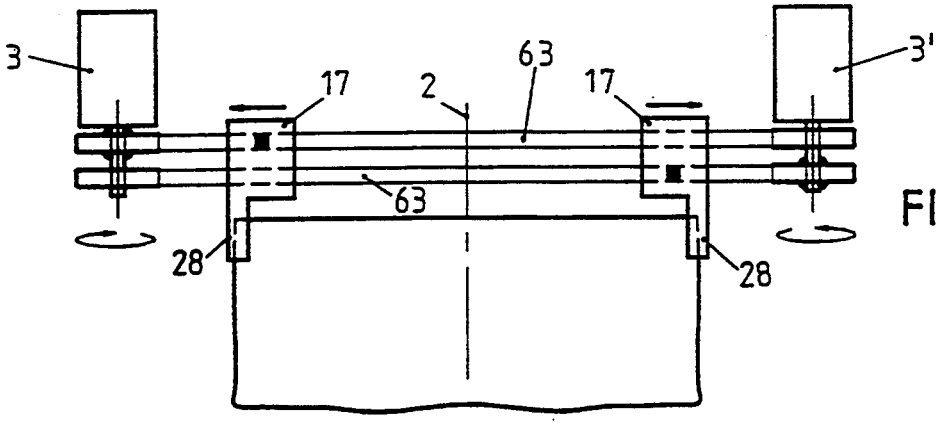
Figure 14D:
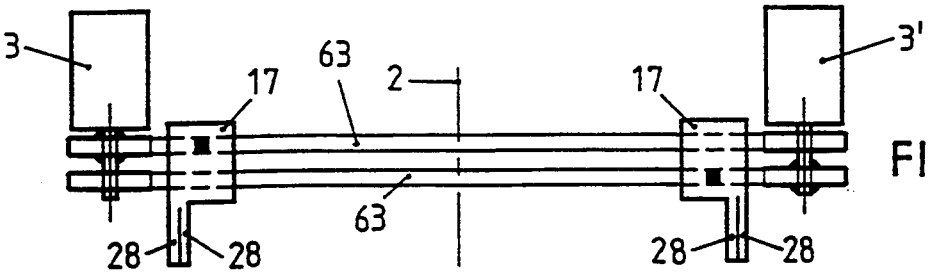
Figure 15A:
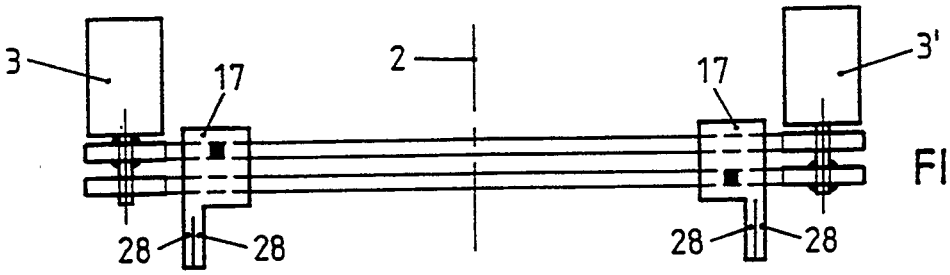
Figure 15B:
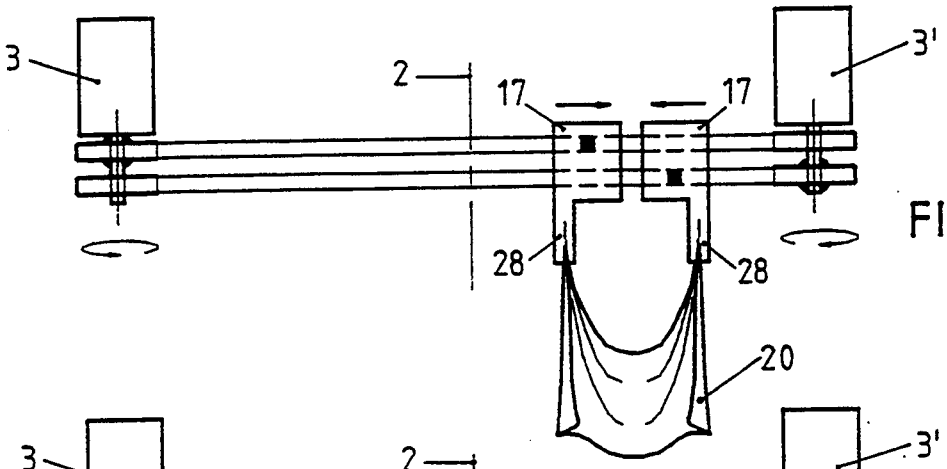
Figure 15C:
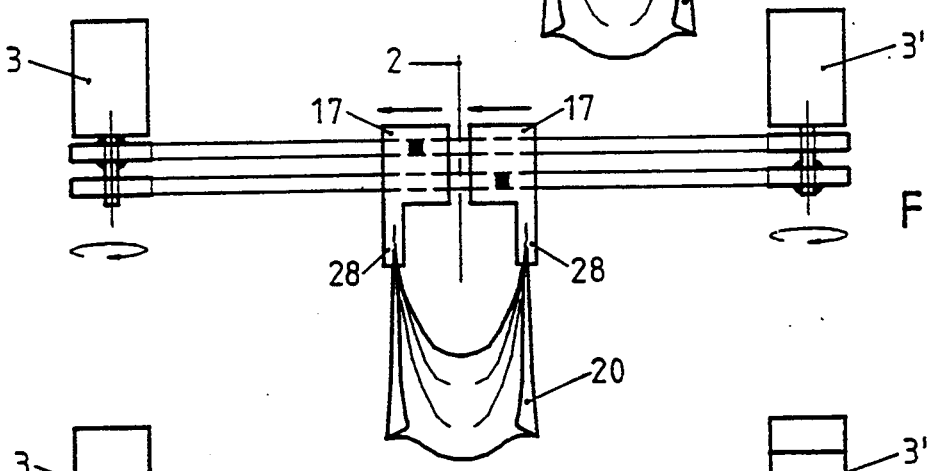
Figure 15D:
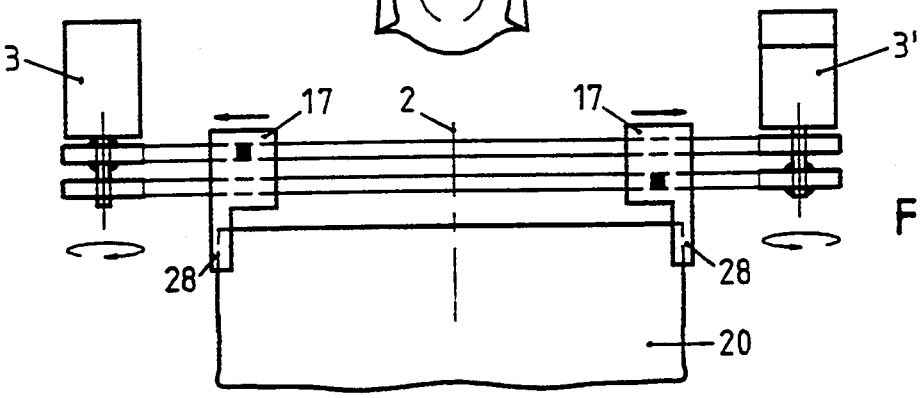
Figure 15E:
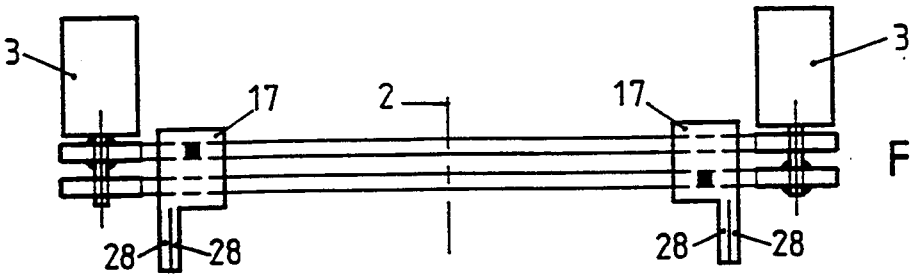
Figure 16A:
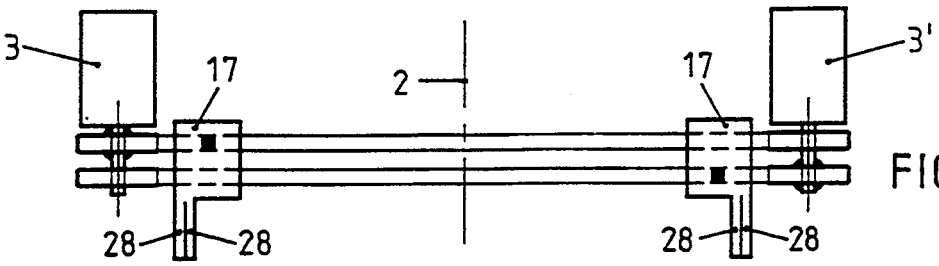
Figure 16B:
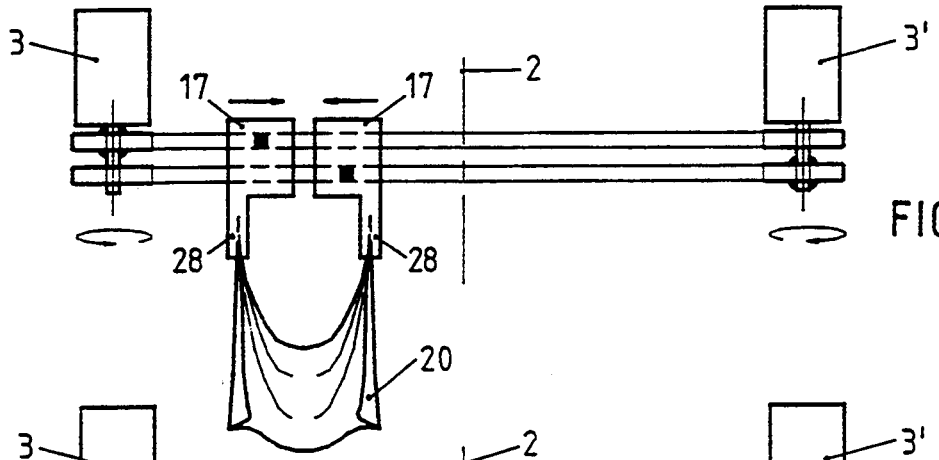
Figure 16C:
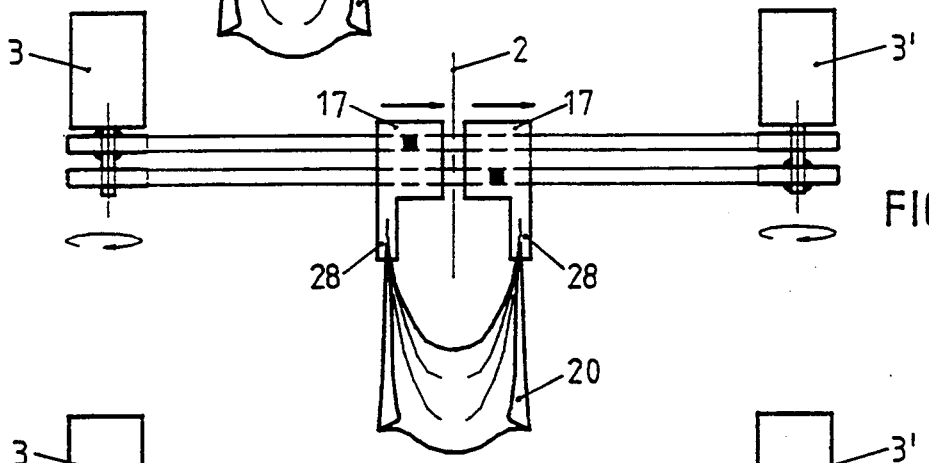
Figure 16D:
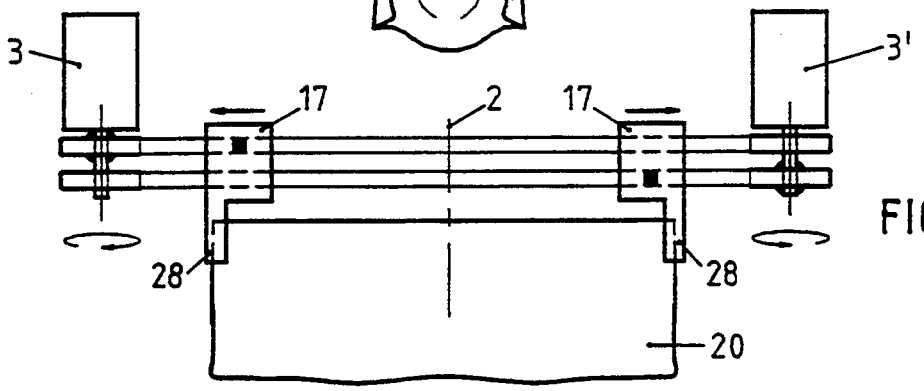
Figure 16E:
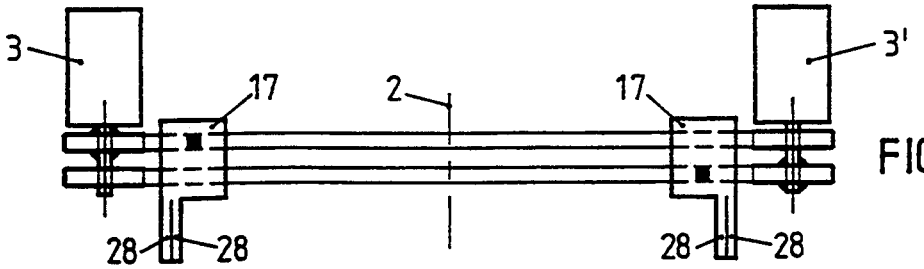

FIG. 13 shows the pneumatic arrangement for the three loading stations of the spreader for injecting air into the clamp cylinders 47 described with reference to FIGS. 9 and 12. This circuit can easily be extended for any multiple number of loading stations as referred to above.

Figure 17:
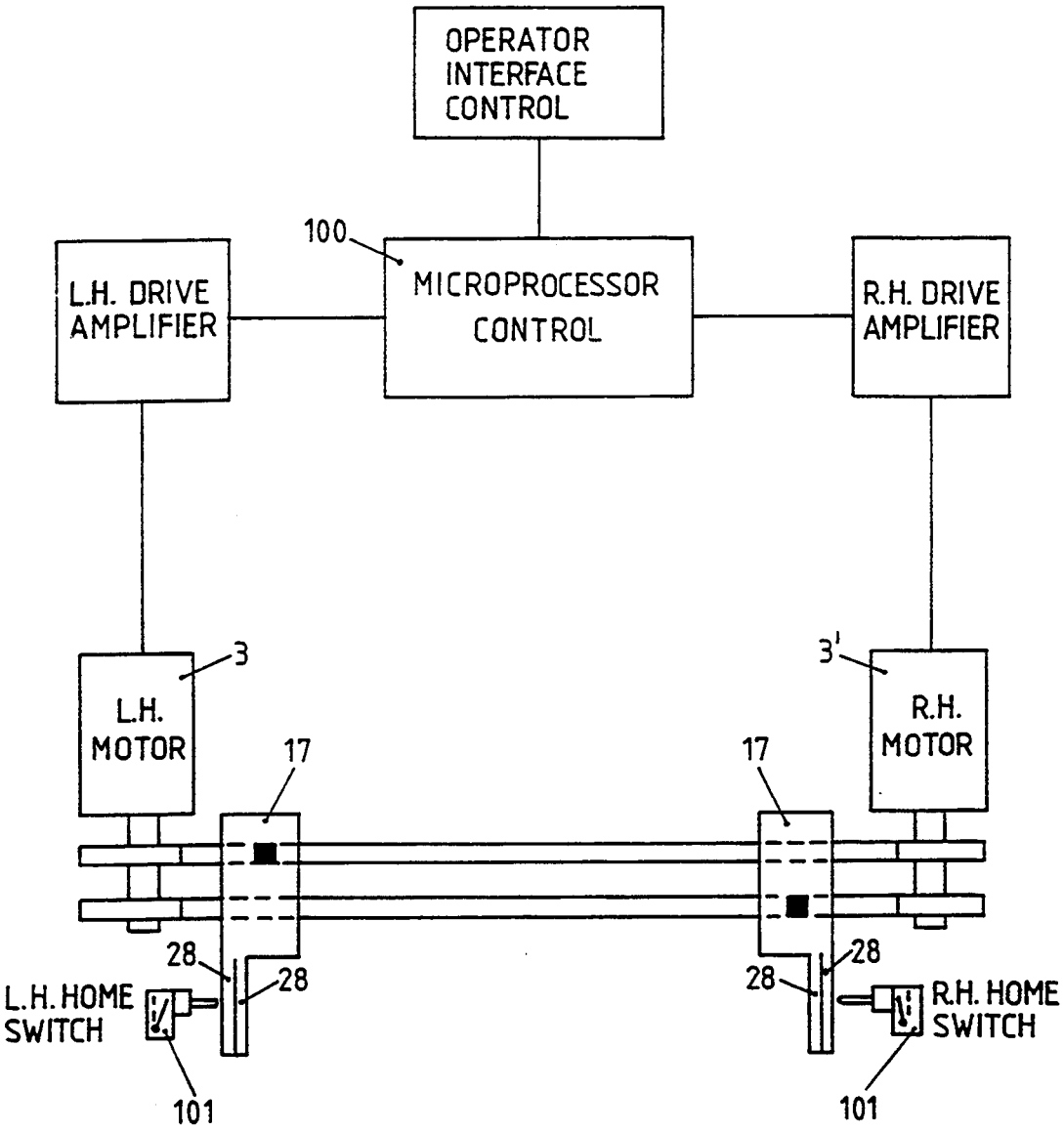
FIG. 17 is a generally schematic diagram illustrating control systems of the apparatus.
Figure 18:
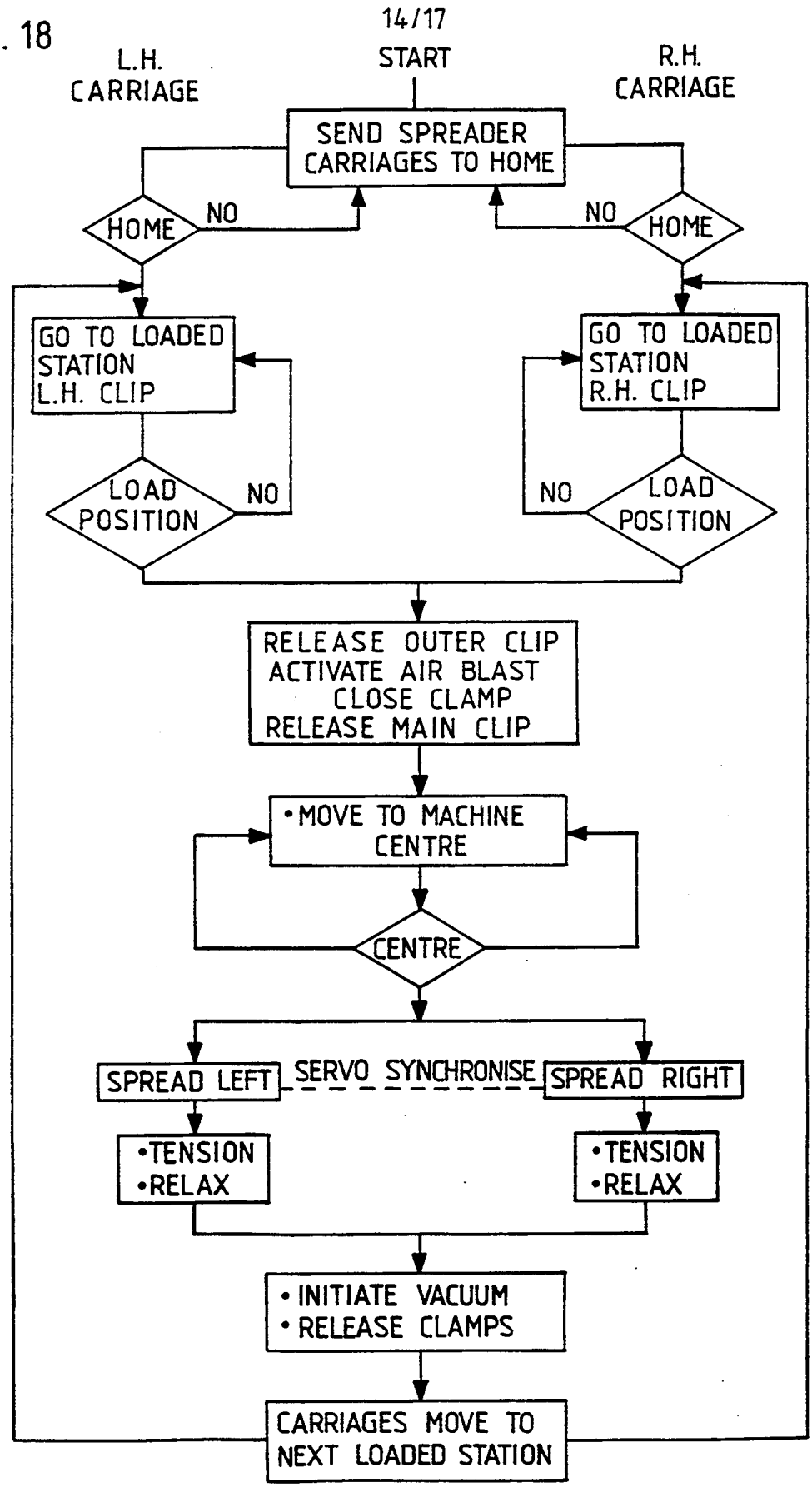
FIG. 18 is a flow chart for the control system shown in FIG. 17.

The basic control sequences of the micro processor control for the preferred application to a sheet feeder using the principles described in European Patent No. 0153069 are as follows with references to the sequence of operations illustrated in FIGS. 14A to 16E and the block diagram of FIG. 17, showing the essential elements of the control circuit and flow diagram of FIG. 18:

1. On initial start up of machine, the servo drives 3, 3' move the clamp spreader carriages 61 carrying clamps 17 along the track to home positions where contact with sensors 101 input signals to the processor 100 to synchronize the servo positional systems.
2. Input signals from the respective loading stations indicate when both corner clips at each station have been loaded with sheet to be delivered to the feeder and are therefore in a "ready" state. These signals are stored in the memory of the processor 100 and are dealt with in order of station loading.
3. The processor directs the servo drives to position the two spreader carriages independently at the next "ready" state load station. For air jet transfer systems, the load station is also simultaneously moved forward into the transfer position ready for transfer.
4. When both carriages and load station are in position, the processor makes output signals to release the outer, subsidiary corner clips, to operate the air jet transfer and to close the clamp jaws via the air injection valves followed by another output which releases the inner, main corner clips and retracts the station to disengage from the clamps. When the main corner clip opens, the top edge drops out of the clips under gravity leaving the sheet transferred to and gripped along its side edges by the spreader clamps.
5. Processor then signals servo drives to commence the sheet spreading sequence; which proceeds as follows:

If the load station from which the sheet has been received is one of the two stations not on the center line of the spreader apparatus, the two carriages 61 first move in tandem to the center line to pass the sheet between the adjacent ends of the left and right hand spreader belt system which the side edges of the sheet are fed into as the sheet is spread. Once the carriages reach the center line or if they are already at the center line having received a sheet at the central loading station, they then separate in opposing directions to spread and tension the sheet.

6. When the selected tension across the sheet is sensed by the processor, the servo drives are automatically braked. The processor then proceeds with the corner release sequence as follows:

The servo drives for the spreader carriages are reversed inward for a short distance to relax tension. The suction feeding duct of the feeding machine is opened and simultaneously the corner clamps are opened by exhausting the air pressure which was injected to close them. The leading edge of the sheet is released and is sucked in the feeding machine and onto the conveyor. From this point on, the sheet is under the control of the feeding machine and the sequence to collect and feed the next sheet will recommence the sequence described. The micro processor program controlling the servo motor drive system is state of the art technology. The precise location of both the spreader carriages and their clamps are known at all stages of the operation and can be independently positioned at any point along the run of the track. The spreader and transfer described are as programmed for a preferred feeding machine. It will, of course, be understood that the spreader is suitable for other forms of feeders. Alternative sequences can be programmed to suit various machines and also for the other forms of transfer clip mechanisms such as the blade insert mechanism shown in FIG. 20 and referred to later or a clip mechanism such as that shown in U.K. Patent No. 1169513.

While three loading stations have been illustrated, it will be understood that four or more loading stations could be provided or just two stations could be used. In addition, two pairs of clamps could be provided, having separate motor driven endless belt drives to supply two parallel lanes of the feeder, i.e. a four axis arrangement, or to feed one lane with an extended width track with two pairs of clamps so that when one pair of clamps is at one end of the spreader track top receive a sheet, the other paid is spreading a sheet and vice verse.

Figure 19A:
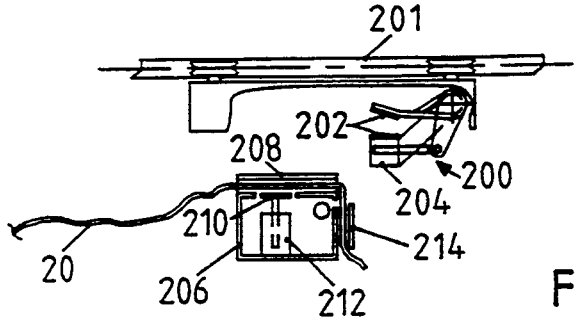
FIGS. 19A–19F are diagrammatic plan views of a first alternative form of sheet clamp and sheet clip showing the stages of clipping and transfer in sequence.
Figure 19B:
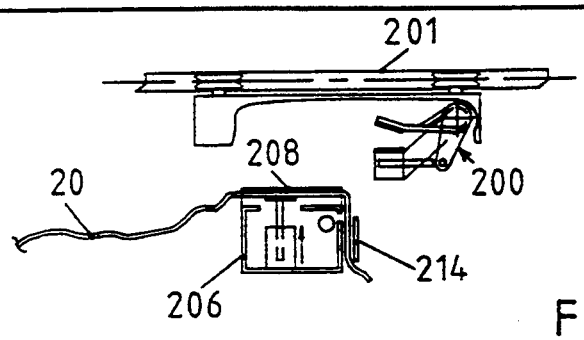
Figure 19C:
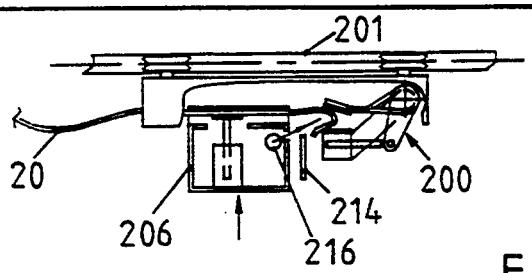
Figure 19D:
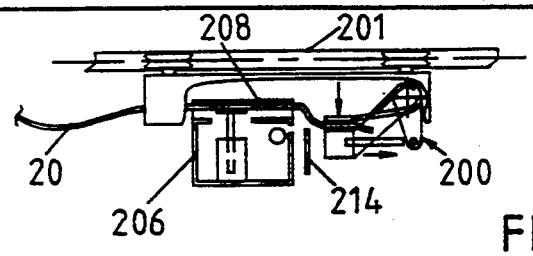
Figure 19E:
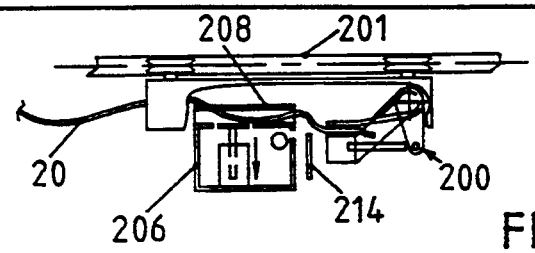
Figure 19F:
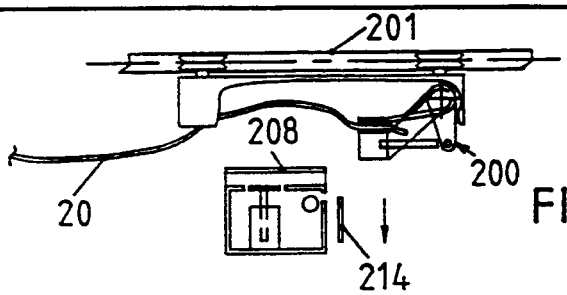

Further forms of clip/clamp mechanism are illustrated in FIGS. 19A–19F and 20A–20E of the drawings. The arrangement of FIG. 19 utilizes an air jet to direct the sheet edge portion from the clip into the clamp. In more detail, a clamp 200 is mounted to a carrier 201 having generally parallel laterally facing jaws 202 actuatable by an air cylinder 204. A clip body is provided with a fixed outer clip jaw 208 depending from the top of the structure confronted by an interior main clip jaw 210 actuatable by an air cylinder 212. A portion of the sheet 20 is passed between the outer clip jaw 208 and the inner jaw 206, and further passes around an adjacent face of the clip body 206 to pass between the clip body and an auxiliary corner clip jaw which is preferably also actuated by an air cylinder (not shown). FIG. 19B shows the clip body 206 with the sheet 20 in place and both jaws 208, 214 compressingly securing sheet 20 thereto. In FIG. 19C it will be seen that the clip body 206 is advanced, and the auxiliary clip 214 is released. An air jet from a source carried with the clip body 206 close the corner of the sheet 23 and in between the jaws 202 of the clamp 200. The air cylinder 204 is then actuated to secure the end of the sheet 20 to the clamp 200. As is seen in FIGS. 19E–19F, the operation of the main clip jaw 208 to a released condition then frees sheet 20 from the clip body, allowing withdrawal of the clip body to provide clearance for subsequent motion of the clamp 200 in carrying the sheet either to spread it or it first center it and then thereafter spread it.

Figure 20A:
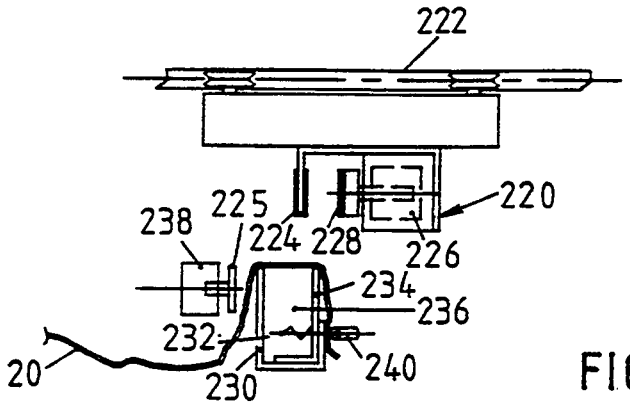
FIGS. 20A–20E are diagrammatic plan views of a second alternative form of clip and clamp showing step by step sheet clipping and transfer to the sheet clamp.
Figure 20B:
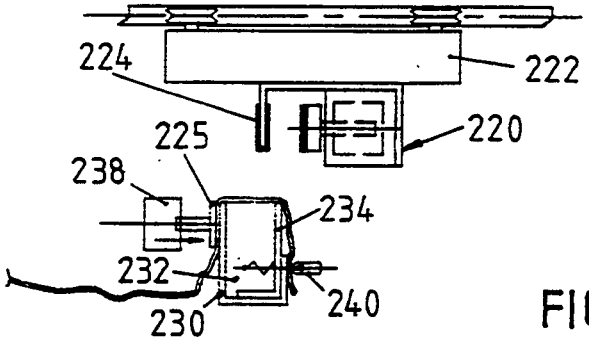
Figure 20C:
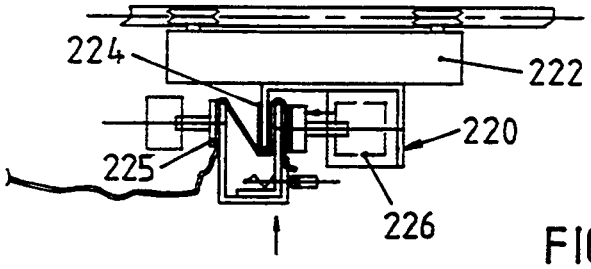
Figure 20D:
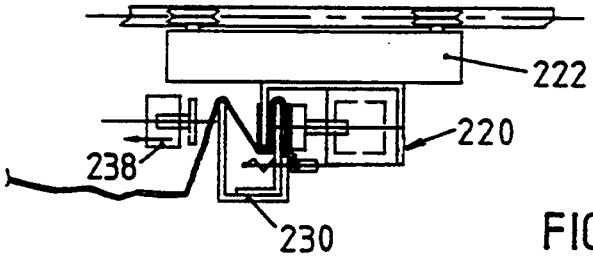
Figure 20E:
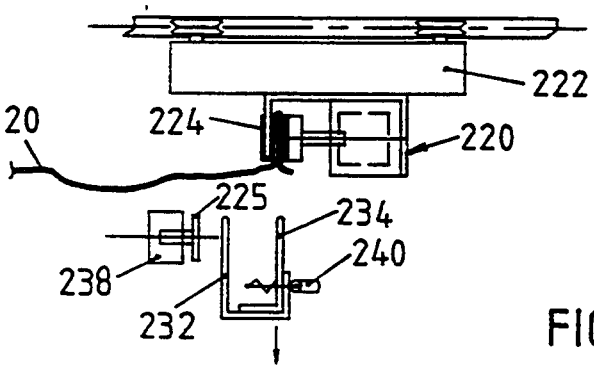

The arrangement of FIGS. 20A–20E provides a clip having a flexible walled channel, one side of which enters the clamp in the transfer position to allow the sheet edge wrapped over the wall to be gripped and relaxed by the clamp when the clip retracts as illustrated. In more detail, a clamp 220 is affixed to a carriage 222 and includes a first clamp jaw 224 configured as a rib extending forward from the carriage 222, and a second clamp jaw 228 disposed in confrontation to the rib 224 and movable into engagement therewith by an air cylinder 226. A generally channel-shaped clip body 230 having a pair of forwardly facing walls 232, 234 define a passage 236 therebetween. Wall 234 is flexibly mounted to the remainder of the clip body 230. In this configuration the main clip jaw 225 faces the outer surface of wall 232 and is actuated by an air piston 238. An auxiliary clamp is disposed to pressingly engage against the other wall 234. Here the clip 240 is shown as a spring-loaded element; however, pneumatic operation thereof is equally feasible. As will be noted in FIG. 20A, with the clamp withdrawn the edge of the sheet 20 is passed between the main clip jaw 225 around the rear of the clip body 230 and across the passage 236, to pass between the auxiliary clip 240 and right hand wall 234. Closure of both clips results in the configuration shown in FIG. 20B. When the clip body 230 is advanced, as shown in FIG. 20C, the rib 224 is forced into the channel 236, thereby carrying a portion of the end of the sheet 20 into the channel, simultaneously pulling the remaining portion of it free of the auxiliary clip 240. At this point the air cylinder 226 is energized, and the clamp jaw 228 presses the folded-around portion of the sheet 20 into engagement with the rib 224 as shown. Next, as shown in FIG. 20D, the main clamp is released, and the clip body 230 is retracted, leaving the end portion of the sheet 20 captively secured between the rib 224 and the clamp jaw 228, thus ending the transfer process.

Figure 21:
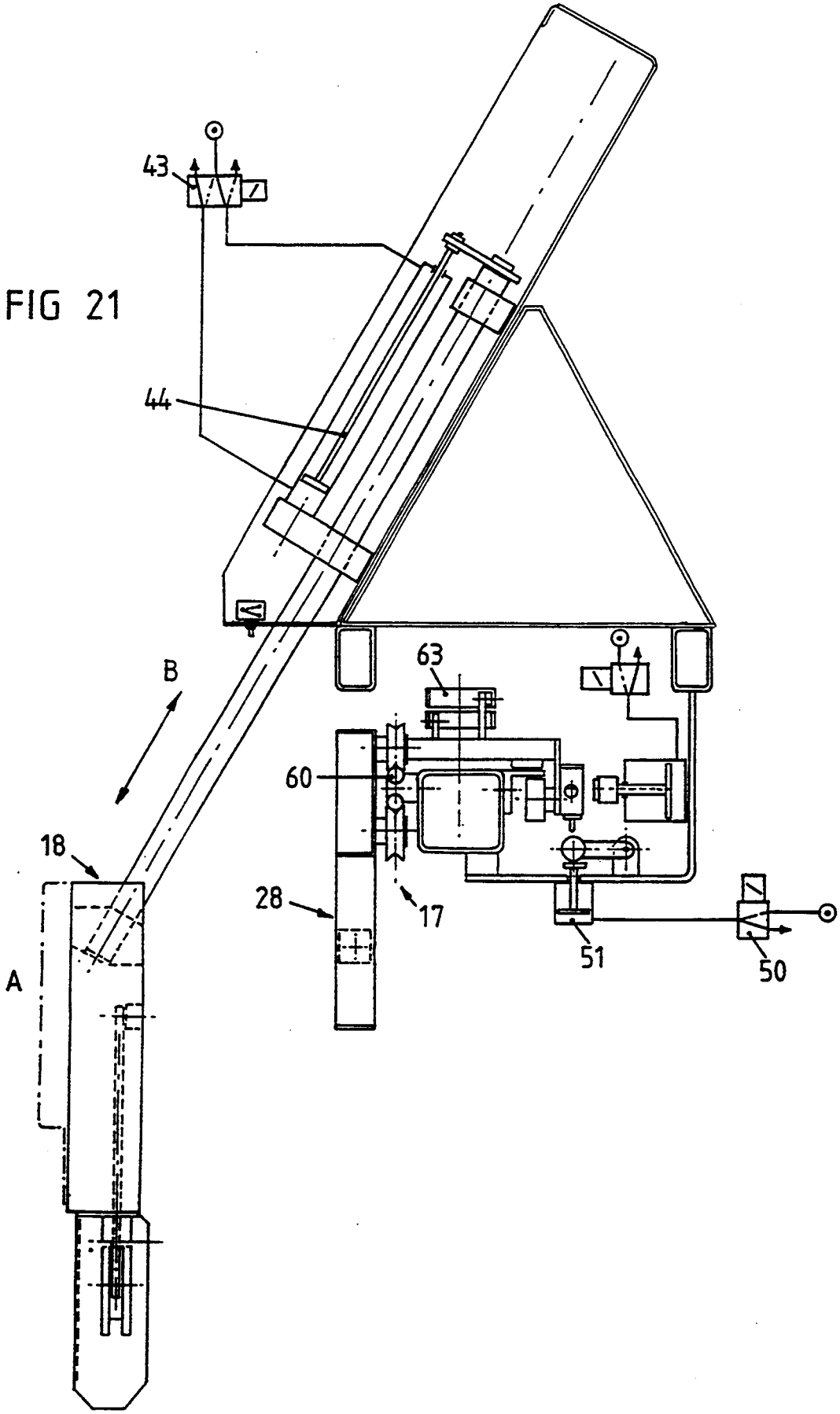
FIG. 21 shows a modified form of load station.

Reference is now made to FIG. 21 of the drawings which illustrates a modification to the load station 18 and like parts have been allotted the same reference numerals. The main difference is that the horizontal movement of the station between loading and transfer positions is modified to extend in an upwardly angled direction from the sheet receiving or loading position A to an elevated transfer position B. By locating guideway and sheet clamps at an elevated position, a greater proportion of the sheet to be spread is lifted off the ground or being raised by the loading station for transfer to the clamps and this makes the sheet move readily spread for entry to the feeder. Preferably, the lower receiving position is adjustable in level for ergonomic reasons. The adjustment is provided by an end stop defining the lower position or by adjustment of the stroke of the cylinder which moves the loading stations up and down.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details. Thus, although the motion of the clamps immediately after transfer has been described as a tandem motion towards the center line of the system, the control system may be readily modified to allow for at least a part of the spreading operation to be done on-the-fly while traveling towards the center to speed up the machine cycle.

I claim:

1. A sheet spreader for a sheet feed apparatus comprising:

at least one pair of sheet clamps each having a pair of separable jaws to receive lengths of the upper extremities of the side edges of a sheet adjacent one of the corners of the sheet to be spread;

means for moving each pair of clamps between adjacent positions at a transfer station where said sheet edges are received and spaced apart locations to spread the sheet therebetween;

a pair of clipping means at a loading station for suspending said sheet adjacent the upper corners thereof, with said upper extremities of the side edges of the sheet located for transfer to the open jaws of a pair of said clamps, each of said sheet clipping means including at least a first section with sheet gripping means for releasably holding a portion of said sheet adjacent a corner thereof and spaced from the side edges of the sheet, and a second section for releasably presenting the associated side edge of the sheet to the spaced apart jaws of the associated clamp; and means for effecting the transfer of said upper extremities of the side edges adjacent the corners of a sheet to the separated jaws of a pair of said clamps at said transfer station while the associated first sections of the clipping means hold said sheet portions and for releasing said first section of each clipping means after the associated clamp jaws are closed, to allow the end of the sheet to be spread by the clamps for entry to the sheet feed apparatus; and means for opening each pair of said clamp jaws when delivered to a transfer station and closing the clamp jaws when the upper extremities of the side edges of a sheet are delivered thereto.

2. A sheet spreader as claimed in claim 1, wherein means are provided for mounting the pair of clipping means at each loading station for movement between a sheet receiving position removed from the sheet clamps and a sheet transfer position in which the sheet corners held by the clipping means are transferred to the sheet clamps.

3. A sheet spreader as claimed in claim 2, wherein the means for mounting moves the clipping means between said receiving and said transfer positions in a generally horizontal direction.

4. A sheet spreader as claimed in claim 2, wherein the means for mounting moves the clipping means between said receiving and said transfer positions in an inclined direction from a lower loading position at a convenient level for an operator and to an upper transfer position to present the sheet end to the clamps and in so doing to lift at least a proportion of the body of the sheet to facilitate spreading of the sheet.

5. A sheet feeder as claimed in claim 2, wherein the clipping means includes a pair of elongate vertically extending flexible tongues which the sheet edges may be wrapped around, the tongues being moved into the sheet clamps by said movement of the clipping means which act to grip and remove the sheet edges from the tongues when the latter retract with the clipping means leaving the sheet edges retained by the clamps.

6. A sheet spreader as claimed in claim 1, wherein the clipping means include means for displacing said side edges of the sheet into the clamps while the sheet is suspending by the clipping means.

7. A sheet spread as claimed in claim 1, wherein the means for transferring said side edges of the sheet supported by the clipping means into the clamps comprise air jet means.

8. A sheet spreader as claimed in claim 7, wherein the clipping means comprise a pair of vertically extending sheet support members mounted side by side one another to face the sheet clamps when the latter are in the loading station, said sheet gripping means comprises releasable sheet clips acting on the adjacent faces of the members to hold the end of the sheet adjacent the corners on the members, means on the remote sides of the members to retain the side edges of the sheet laid against the members facing towards the clamps and said air jet means positioned on the members directed towards the clamps when in the loading station thereof to displace the side edges of the sheet laid on the members into the clamps when the latter are in said transfer position.

9. A sheet spreader as claimed in claim 8, wherein the support members are of hollow box form having an elongate slit extending down the sides of the members facing the clamps in the transfer position and wherein said jet means comprises means for supplying air under pressure to the hollow members to issue as an elongate jet from the slit to blow the sheet side edges laid against the members into the clamps.

10. A sheet spreader as claimed in claim 8, wherein the means for retaining the side edges of the sheet laid against the support members of the clipping means comprise presser elements biased against the remote sides of the support members to hold the side edges of the sheet against the members with a relatively light pressure and means are provided to relieve the presser elements to allow release of the side edges of the sheet for transfer into the clamps.

11. The sheet spreader as claimed in claim 1, wherein said first and second sections of said clipping means respectively having first and second pressure-receiving surfaces, said gripping means of said first section of said clipping means including a first pressure member movable into pressing engagement with and away from said first pressure receiving surface and positioned to supportingly secure a first region of said upper extremities of said sheet spaced a given distance from a corner of said sheet when said first pressure member is urged towards said first pressure-receiving surface, clipping means includes a second pressure member movable into pressing engagement with said second pressure-receiving surface and positioned to supportingly secure a second region of the upper extremities of said sheet between said first region and the associated corner of an inserted sheet when said second pressure member is urged towards said second pressure-receiving surface, means for initially moving said second pressure member to a pressing position to supportingly engage said second region and said first pressure member to said pressing position to supportingly engage said first region of the sheet, sheet moving means for moving at least said second region of said upper extremity of said sheet from behind said second pressure member and inserting the same between the jaws of the associated clamp while said first pressure member retains its grip on said sheet, and means for next moving said jaws to a closed position and then operating said first pressure member to a releasing position.

12. The spreader as claimed in claim 11, wherein said clipping means includes a support member having said first and second pressure-receiving surfaces on opposite sides thereof, said sheet moving means includes a source of gas under pressure oriented to force said second region of the upper extremities of said sheet between the jaws of the associated clamp upon operation of said second pressure member to a releasing condition.

13. The spreader as claimed in claim 11, wherein said clipping means includes a support member having said first and second pressure-receiving surfaces on adjacent sides thereof, said sheet moving means having associated therewith a source of gas under pressure oriented to force said second region of the upper extremities of said sheet between the jaws of the associated clamp upon operation of said second pressure member to a releasing condition.

14. The spreader as claimed in claim 11, wherein one jaw of each said clamp is configured as a vertically oriented rib, said clipping means includes a support member having a passage between said first and second pressure-receiving surfaces configured to accommodate insertion of said rib, and means for moving said support member between an initial withdrawn position with said rib disposed outside said passage and an advanced position wherein said rib extends into said passage, and means for moving said support member from said withdrawn to said advanced position during which movement said sheet is released from said second pressure member, means for next operating said jaws to a closed condition, and means for next operating said first pressure member to a releasing condition and said support member to said withdrawn position.

15. The sheet spreader of claim 1 wherein said second section of each clipping means includes sheet gripping means movable from a sheet gripping position to a sheet releasing position, and includes means for moving said second section of each clipping means to said sheet releasing position when the sheet is to be transferred to a separated pair of clamp jaws.

16. A sheet spreader for a sheet feeder apparatus comprising:

at least one pair of sheet clamps, guideway means to extend along an entry to a sheet feeder;

means for mounting the clamps on the guideway means for independent movement to adjacent or spaced apart positions along the entry to the sheet feeder;

a plurality of sheet transfer stations along said guideway means, a plurality of loading stations located at fixed positions opposite said transfer stations along the guideway means, clamp moving means for moving said clamps in adjacent positions opposite a selected transfer station and between the stations, each loading station having a pair of sheet clipping means for receiving and supporting a pair of corners of a sheet, means for effecting transfer of the sheet corners from the pair of clipping means to the pair of clamps delivered to the adjacent transfer station on the guideway means, said clamp moving means following transfer of the sheet corners to the pair of clamps at a transfer station moving the clamps to a spreading position where the clamp are moved apart to spread the sheet received at a loading station for entry to the sheet feeder.

17. The sheet spreader as claimed in claim 16, wherein said spreading position is a central location along the guideway means before the clamps are moved apart to spread the sheet.

18. A sheet spreader as claimed in claim 16, wherein said sheet clamps are supported on carriages to be moved between the sheet loading stations, and are provided drive means for moving the carriages between said loading stations.

19. A sheet spreader as claimed in claim 18, wherein said drive means includes servo motors having torque sensitive controls for stopping the motors when the torque delivered by the motors reaches a predetermined amount indicating that the sheet has been spread to its fullest extent.

20. A sheet spreader as claimed in claim 19, wherein the torque responsive controls include means for effecting a small reversal of the motors after the torque has reached said predetermined level to release the tension imposed on the sheet by spreading the sheet.

21. A sheet spreader as claimed in claim 20, wherein the sheet clamps are pneumatically operated having air inlets to communicate with a source of air pressure facing transversely of the path of movement of the clamps, and an air pressure supply is provided having a pair of spaced nozzles located side by side at the transfer station to register with the clamp inlets and means are provided to move the nozzles into and out of engagement with the clamp inlets to supply air thereto for operating the clamps.

22. A sheet spreader as claimed in claim 21, wherein the means to move the nozzles comprises a ram operated carrier for the nozzles and the air supply for the nozzles also supplies the carrier arm.

23. A sheet spreader as claimed in claims 21 or 22, wherein the pneumatically operated clamps have valve means to retain air pressure therein to maintain the clamps closed and pressure release means to allow the clamps to open and separate means are provided extending along the path of movement of the clamps and operable to actuate the pressure release means when the clamps reach their spread positions.

24. The sheet spreader of claims 1 or 20 wherein said clamp jaws are configured so that sheet engaging portions of said clamp jaws are in planes at right angles to the plane of the engaged sheet when spread by said clamps.

25. The sheet spreader of claim 24 wherein said sheet engaging portions of said clamp are much longer in the direction of said side edges of said sheet than the width thereof.

26. The sheet spreader as claimed in claim 16 wherein each of said clamps includes a pair of clamp jaws operable between open and closed conditions; and said clipping means having first and second pressure-receiving surfaces, a first pressure member movable into pressing engagement with and away from said first pressure receiving surface and positioned to supportingly secure a first region of said upper extremities of said sheet spaced a given distance from a corner of said sheet when said first pressure member is urged towards said first pressure-receiving surface, a second pressure member movable into pressing engagement with said second pressure-receiving surface and positioned to supportingly secure a second region of the upper extremities of said sheet between said first region and the associated corner of an inserted sheet when said second pressure member is urged towards said second pressure-receiving surface, means for initially moving said second pressure member to a pressing position to supportingly engage said second region and said first pressure member to said pressing position to supportingly engage said first region of the sheet, sheet moving means for moving at least said second region of said upper extremity of said sheet from behind said second pressure member and inserting the same between the jaws of the associated clamp while said first pressure member retains its grip on said sheet, and means for next moving said jaws to a closed position and then operating said first pressure member to a releasing position.

* * * * *